US010624504B1

(12) United States Patent
Babikian et al.

(10) Patent No.: US 10,624,504 B1
(45) Date of Patent: Apr. 21, 2020

(54) FOAM DISPENSER WITH SELECTOR FOR CONTROLLING LIQUID PUMP AND AIR PUMP OUTPUT AND METHOD OF OPERATING THE SAME

(71) Applicant: BOBRICK WASHROOM EQUIPMENT, INC., North Hollywood, CA (US)

(72) Inventors: Dikran Babikian, Glendale, CA (US); Nikhil Jain, North Hollywood, CA (US)

(73) Assignee: BOBRICK WASHROOM EQUIPMENT, INC., North Hollywood, CA (US)

( * ) Notice: Subject to any disclaimer, the term of this patent is extended or adjusted under 35 U.S.C. 154(b) by 0 days.

(21) Appl. No.: 16/191,347

(22) Filed: Nov. 14, 2018

(51) Int. Cl.
*A47K 5/14* (2006.01)

(52) U.S. Cl.
CPC ..... *A47K 5/14* (2013.01)

(58) Field of Classification Search
CPC ..... A47K 5/14
USPC ..... 222/145.1, 145.6, 190, 459
See application file for complete search history.

(56) References Cited

U.S. PATENT DOCUMENTS

| | | | | |
|---|---|---|---|---|
| 3,970,219 | A | 7/1976 | Spitzer et al. | |
| 5,064,103 | A | 11/1991 | Bennett | |
| 5,071,379 | A | 12/1991 | Poizot | |
| 5,842,607 | A | 12/1998 | Snider | |
| 6,797,319 | B2 | 9/2004 | Capizzi | |
| 8,225,965 | B2 | 7/2012 | Arminak | |
| 8,292,128 | B2 * | 10/2012 | Hagleitner | A47K 5/16 222/190 |
| 8,496,142 | B2 | 7/2013 | Uehira et al. | |
| 8,991,657 | B2 | 3/2015 | Ciavarella et al. | |
| 9,004,318 | B2 | 4/2015 | Kodama et al. | |
| 9,072,412 | B2 | 7/2015 | Ciavarella et al. | |
| 9,554,675 | B2 * | 1/2017 | Babikian | B01F 5/0693 |
| 9,730,558 | B2 * | 8/2017 | McNulty | A47K 5/14 |
| 10,010,224 | B2 | 7/2018 | Pelfrey | |
| 10,080,466 | B2 | 9/2018 | Ciavarella et al. | |

(Continued)

FOREIGN PATENT DOCUMENTS

| | | |
|---|---|---|
| DE | 32 47 645 A1 | 7/1984 |
| EP | 0 336 188 A2 | 10/1989 |

(Continued)

OTHER PUBLICATIONS

International Search Report and Written Opinion issued in International Application No. PCT/US2012/049060, dated Nov. 26, 2013/ Feb. 1, 2014, 11 pages.

(Continued)

*Primary Examiner* — Vishal Pancholi
(74) *Attorney, Agent, or Firm* — Lewis Roca Rothgerber Christie LLP

(57) ABSTRACT

A foam dispenser includes an air pump for pumping and outputting air, a liquid pump for pumping and outputting liquid soap, a mixing chamber for receiving the liquid soap and the air, and a controller for inversely controlling the outputs of the liquid pump and the air pump. A method of controlling the quality of foam produced by a foam dispenser including a liquid soap pump and an air pump includes simultaneously inversely varying the output of each of the pump for adjusting the quality of the foam produced.

21 Claims, 8 Drawing Sheets

(56) References Cited

U.S. PATENT DOCUMENTS

| | | | | |
|---|---|---|---|---|
| 10,080,467 | B2 | 9/2018 | Ciavarella et al. | |
| 10,080,468 | B2 | 9/2018 | Ciavarella et al. | |
| 10,092,142 | B2 | 10/2018 | Chang | |
| 2004/0177975 | A1* | 9/2004 | Laskaris | A62C 5/02 169/13 |
| 2005/0258192 | A1* | 11/2005 | Matthews | A47K 5/14 222/190 |
| 2006/0011655 | A1* | 1/2006 | Ophardt | A47K 5/16 222/190 |
| 2007/0114243 | A1 | 5/2007 | Kershaw et al. | |
| 2007/0152082 | A1* | 7/2007 | Hyslop | E03C 1/0404 239/428 |
| 2007/0278247 | A1 | 12/2007 | Banks et al. | |
| 2012/0048891 | A1 | 3/2012 | Hagleitner | |
| 2012/0067923 | A1 | 3/2012 | Matthews et al. | |
| 2013/0048755 | A1 | 2/2013 | Uehira et al. | |
| 2013/0102071 | A1 | 4/2013 | Pan et al. | |
| 2013/0119083 | A1 | 5/2013 | Ophardt et al. | |
| 2013/0200109 | A1 | 8/2013 | Yang et al. | |
| 2013/0292419 | A1 | 11/2013 | Quinlan et al. | |
| 2013/0292420 | A1 | 11/2013 | Mizushima | |
| 2013/0299517 | A1 | 11/2013 | Ciavarella et al. | |
| 2013/0313285 | A1 | 11/2013 | Iizuka et al. | |
| 2013/0341358 | A1 | 12/2013 | Ciavarella et al. | |
| 2015/0102053 | A1* | 4/2015 | Gray | A47K 5/1207 222/1 |
| 2018/0153353 | A1 | 6/2018 | Takagi | |

FOREIGN PATENT DOCUMENTS

| | | | |
|---|---|---|---|
| EP | 1 844 690 | A2 | 10/2007 |
| WO | WO 00/09251 | | 2/2000 |
| WO | WO 03/102301 | A1 | 12/2003 |

OTHER PUBLICATIONS

International Preliminary Report on Patentability issued in International Application No. PCT/US2012/049060, dated Feb. 4, 2014; 8 pages.

Office action and Examination search report issued in corresponding Canadian Patent Application No. 2843309, dated Mar. 5, 2018, 4 pages.

Extended European search report issued in the corresponding European Patent Application No. 17195689.9, dated Mar. 16, 2018, 5 pages.

International Search Report and Written Opinion issued in related International Application No. PCT/US2019/033400, dated Aug. 27, 2019, 11 pages.

* cited by examiner

FOAM DISPENSER WITH SELECTOR FOR CONTROLLING LIQUID PUMP AND AIR PUMP OUTPUT AND METHOD OF OPERATING THE SAME

BACKGROUND

Foam soap dispensers are used in public restrooms and other areas. They may be automatic or manually operated. Foam soap dispensers generally form foam by mixing a stream of liquid soap with a stream of air in a mixing chamber under force or pressure. In order to obtain a more homogenous texture of foam, the mixed stream of liquid soap and air is passed through a mesh (or screen) in the mixing chamber to generate the foam. The liquid soap is supplied to the chamber using a pump. Similarly, the air is supplied to the mixing chamber by either using a type of pump or by sucking the ambient air into the mixing chamber and mixing it with the liquid soap stream, as is the case in manually operating soap dispensers. As can be seen in FIGS. 1 and 2, a soap dispenser 10 may be mounted on a counter 12. A reservoir 14 for the liquid soap and the air source 16 may be mounted or located a distance away from the actual dispensing location (i.e. the dispensing opening or outlet) 18 of a dispenser spout 20. In one type of setting, the dispenser spout 20 typically has a dispensing opening 18 which dispenses the foam. In hands-free operation type of foam dispensers, a sensor such as an infrared sensor 22, is mounted proximate the tip of the dispenser. The sensor 22 senses a user's hand underneath the dispenser, and sends a signal to a controller 24, such as a microprocessor, which in turn sends a signal to operate a pump 28 for pumping the liquid soap from the reservoir 14 and to a pump 27 for pumping the air from a source 30 air into a mixing chamber 32. The controller may be coupled to a power source 25, such as a battery or an electricity source for powering the controller, sensor and/or the pumps. In order to obtain a better texture of foam, one or more screens 34 (typically two or three screens) are placed in the mixing chamber 32. The meshes can become clogged with towel fibers, debris and dried soap. As the meshes become clogged, the quality of the foam and the texture of the foam decreases. Eventually, the screens become completely clogged thus, prevent the dispensing of foam. As the meshes can be under the counter and/or within the soap dispenser, they may be difficult to access for cleaning. For example, with some foam dispensers generally a "skirt" or removable panel is used under the counter to cover the plumbing fixtures and subsequently the soap dispenser from view of the user. This creates difficulty for maintenance personnel to replace components or to access and clean the meshes as such panels have to be removed. Moreover, with many foam dispensers, as the type of liquid soap that is used is varied so is the quality foam produced.

Consequently, a more robust foam dispenser is desired that can produce a more consistent quality of foam even when different types of liquid soap are used.

SUMMARY

An example embodiment foam dispenser includes an air pump for pumping and outputting air, a liquid pump for pumping and outputting liquid, a mixing chamber for receiving the liquid and the air, and a controller for inversely controlling the outputs of the liquid pump and the air pump. In another example embodiment, the controller allows for increasing of the output of one of the liquid and air pumps while simultaneous decreasing the output of the other of the liquid and air pumps. In yet another example embodiment, each pump is powered by a voltage source and the controller is a potentiometer. In a further example embodiment, each pump is powered by a voltage source and the controller controls the amount of voltage supplied to each pump. In yet a further example embodiment, the controller controls the amount of voltage supplied to each pump, and the controller includes a selector that is moveable from a first position to a second position such that the amount of voltage supplied to the liquid pump is at a predefined maximum at the first position and at a predefined minimum at the second position, and the amount of voltage supplied to the air pump is at a predefined minimum at the first position and at a predefined maximum at the second position. In one example embodiment, the predefined maximum voltage for the liquid pump is 6 volts and the predefined maximum voltage for the air pump is 4.2 V. In another example embodiment, the predefined minimum voltage for the liquid pump is 3.3 volts and the predefined minimum voltage for the air pump is 1.92 V. In yet another example embodiment, the predefined maximum voltage for the liquid pump is 6 volts and the predefined minimum voltage for the air pump is 1.92 V. In a further example embodiment, the predefined minimum voltage for the liquid pump is 3.3 volts and the predefined maximum voltage for the air pump is 4.2 V. In yet a further example embodiment, the predefined maximum voltage for the liquid pump is greater than the predefined maximum voltage for the air pump. In another example embodiment, the predefined minimum voltage for the liquid pump is greater than the predefined minimum voltage for the air pump. In yet another example embodiment, the predefined minimum voltage for the liquid pump is less than the predetermined maximum voltage for the air pump. In a further example embodiment, when the controller selector is at the second position, the air pump is operating at 70% of its maximum speed. In yet a further example embodiment, as the controller selector is moved from the first position to the second position, the voltage supplied to the liquid pump is gradually decreased from its predefined maximum to its predefined minimum and the voltage supplied to the air pump is gradually increased from its predefined minimum to its predefined maximum, and as the controller selector is moved from the second position to the first position, the voltage supplied to the liquid pump is gradually increased from is predefined minimum to its predefined maximum and the voltage supplied to the air pump is decreased from its predefined maximum to its predefined minimum. In one example embodiment, the variance in voltage supplied to the liquid pump as the selector is moved from the first position to the second position is linear and the variance in the voltage supplied to the air pump is linear.

In another example embodiment, a method of controlling the quality of foam produced by a foam dispenser including a liquid soap pump and an air pump includes simultaneously inversely varying the output of each of the pump for adjusting the quality of the foam produced.

DETAILED DESCRIPTION

Figure 3:
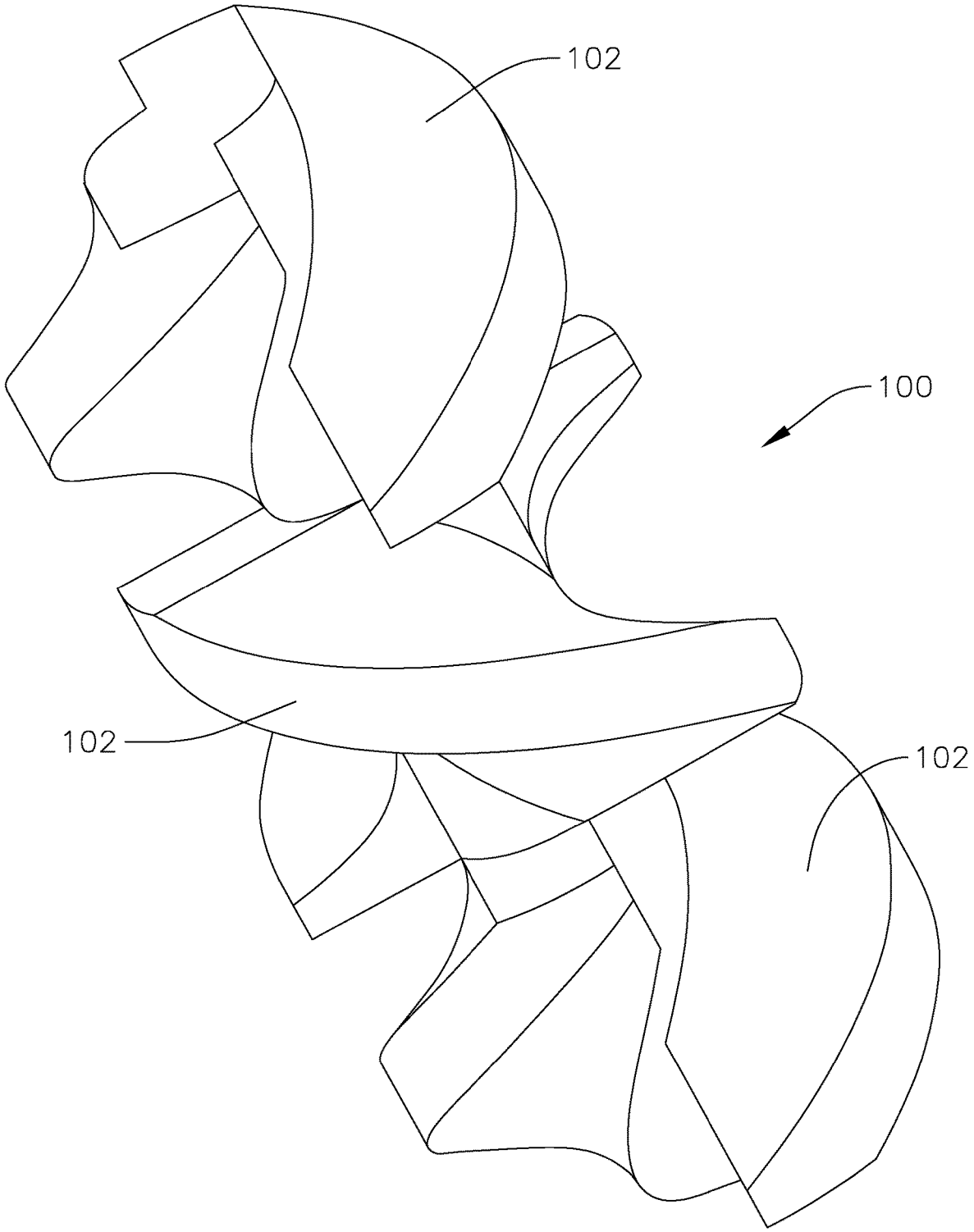
FIG. 3 is a perspective view of an example embodiment agitator.
Figure 4A:
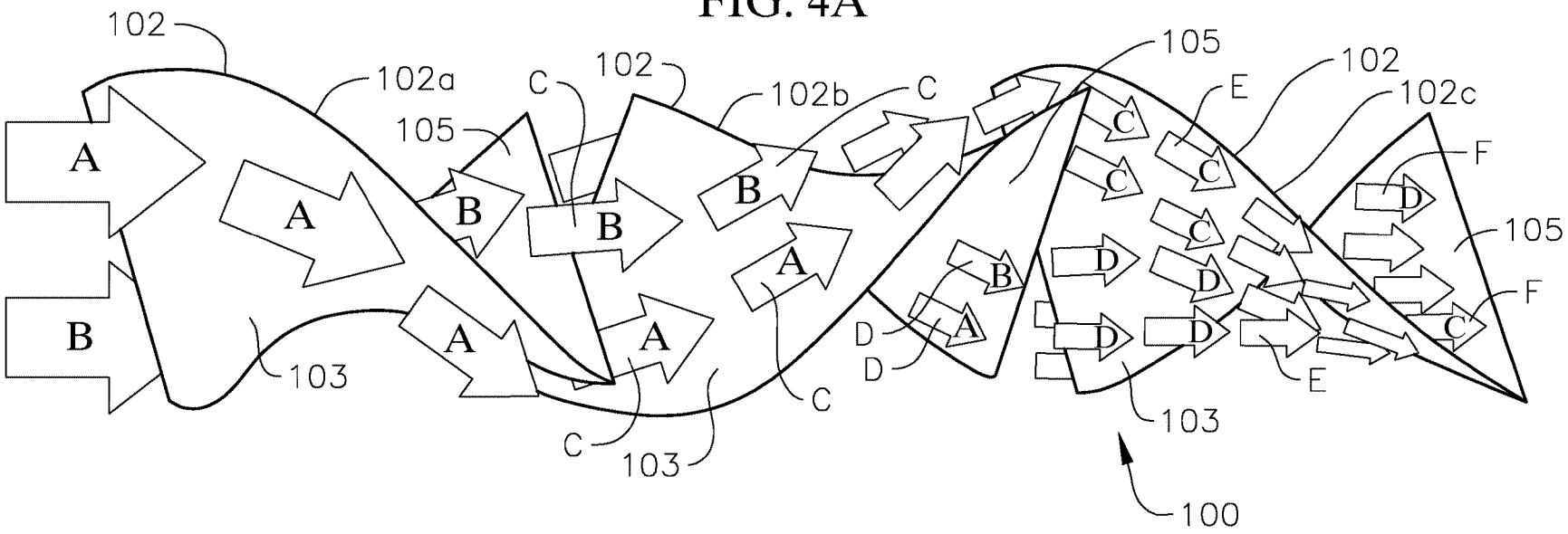
FIG. 4A is a plan view depicting flow division across the example embodiment agitator shown in FIG. 3.
Figure 4B:
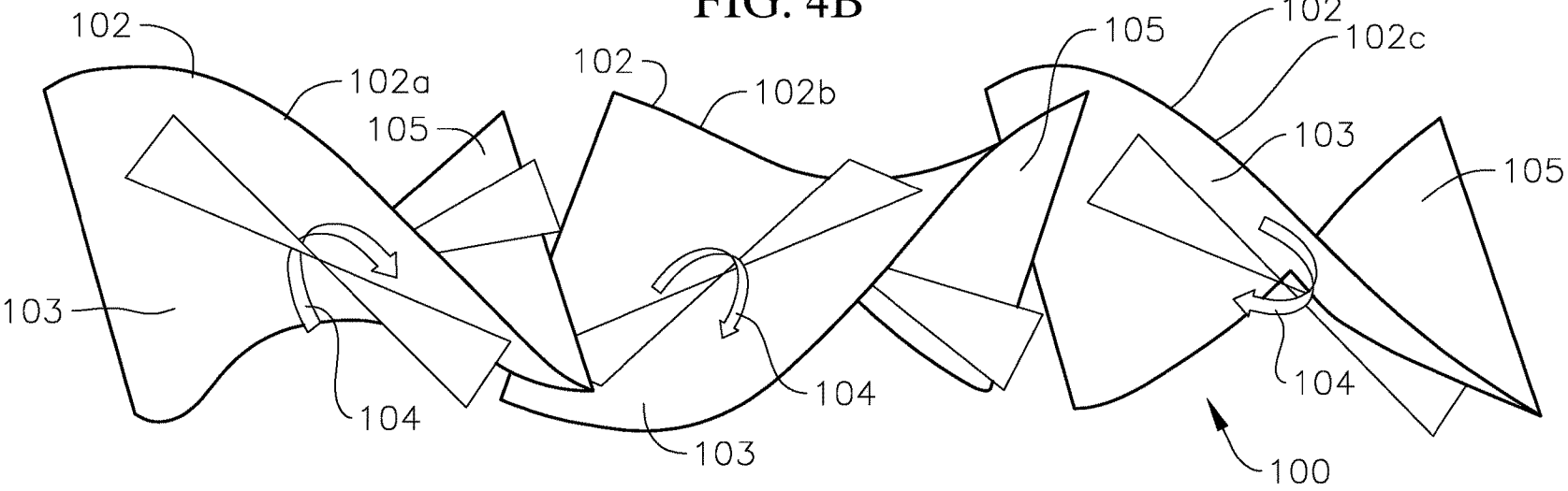
FIG. 4B is a plan view depicting radial mixing of a flow across the example embodiment agitator shown in FIG. 3.

To overcome the problems of the prior art foam dispensers, applicants have developed a foam dispenser which utilizes one or more agitators 100 (also known as static inline mixers). An "agitator" as used herein is a device that is fitted into a conduit for causing a fluid flowing through the conduit to change directions multiple times as it engages and travels through the agitator within the conduit. In one example embodiment, the agitator causes the flowing fluid to divide and recombine multiple times. In other words, the agitator causes the fluid flow to divide into multiple fluid flow paths and then recombine. It then repeats the same process one or more times as the flow continues along the conduit and past the agitator. Such example embodiment agitator is shown in FIG. 3. It is sometimes referenced to as a helical mixer. The helical mixer or agitator includes multiple mixing elements 102 which themselves are helical. The flow divides as can be seen in FIG. 4A into two flows depicted by arrow A and B, respectively, as they pass through the first element 102*a*. The two flows combine and divide into two flows on opposite helical side surfaces 103, 105 of a second element 102*b*, forming two flows C and D, respectively. The two new flows combine on each helical side surface of a third element forming two new flows, E and F respectively. There is also radial mixing of the flows that occurs on each helical side surface of each element as depicted in FIG. 4B by arrow 104. In an example embodiment each agitator used with an example embodiment dispenser has at least two helical elements 102. In another example embodiment it has at least three helical elements. In other example embodiments, other types of agitators or inline static mixers may be used such as for example, Koflo Blade™ agitators. As can be seen, an agitator provides for mixing through a three-dimensional space, whereas, a screen provides for mixing across the thickness of the screen which is akin to a two-dimensional space.

Figure 1:
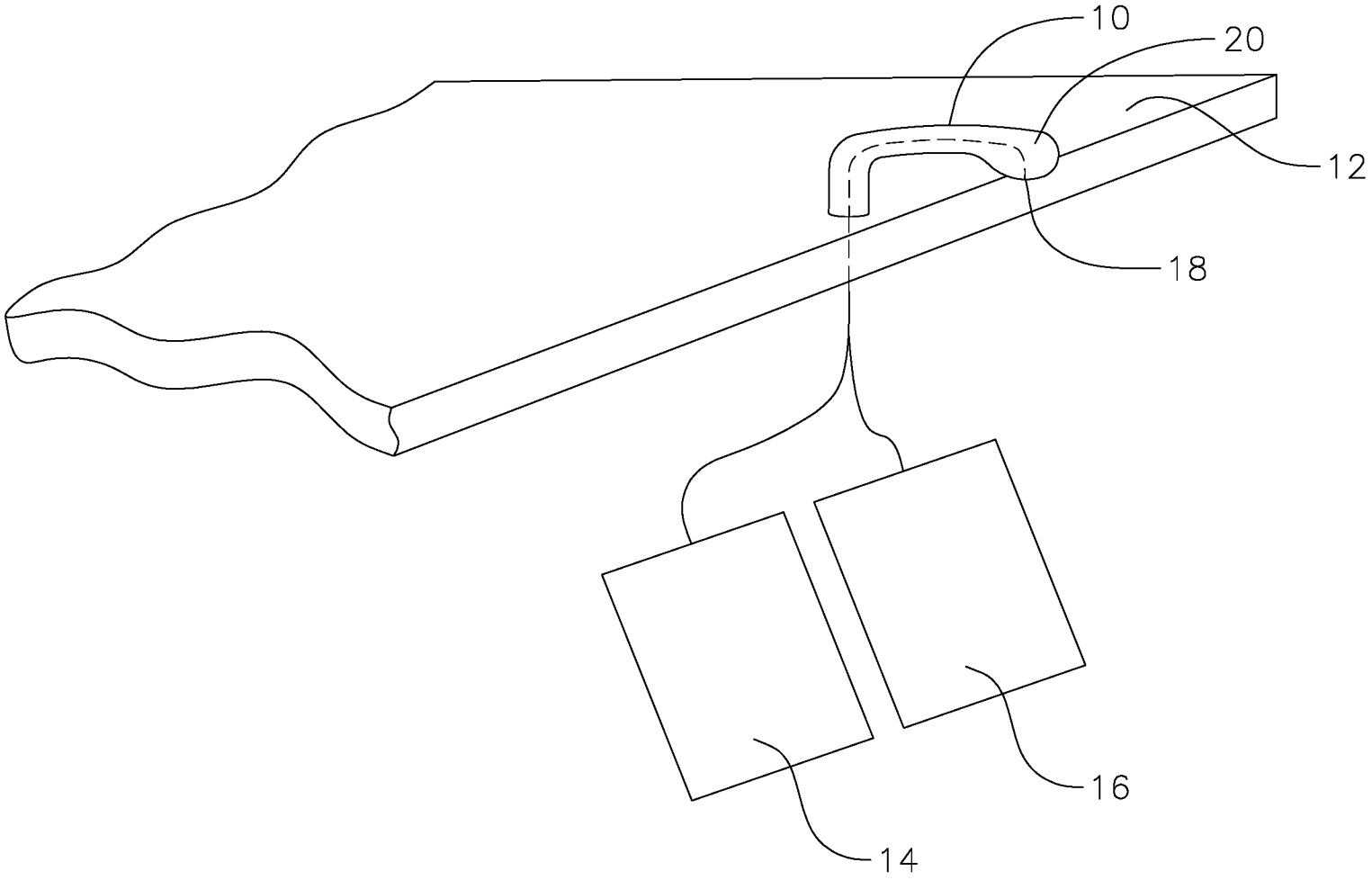
FIG. 1 is a schematically depicted view of a foam dispenser mounted on a counter.
Figure 2:
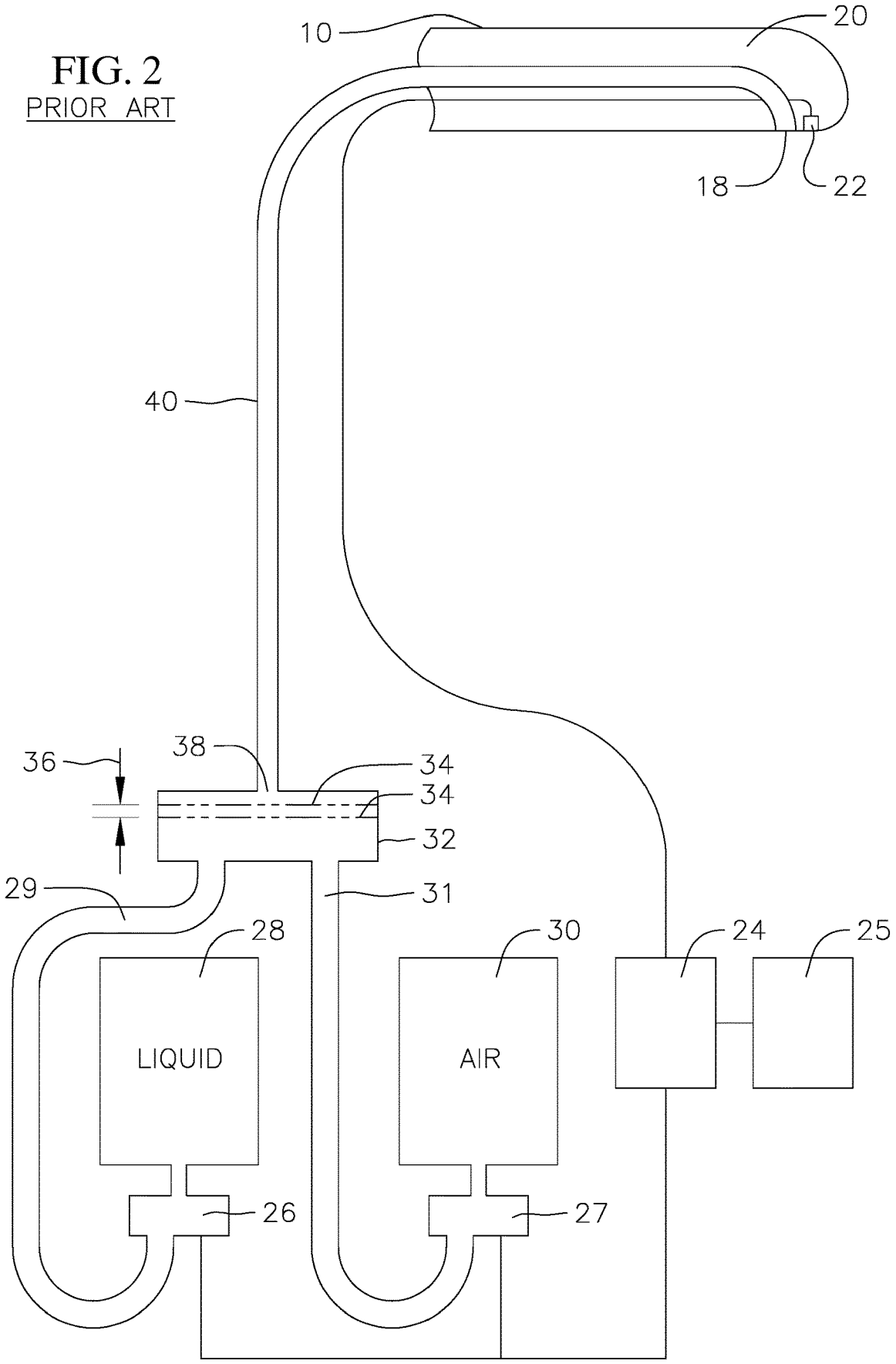
FIG. 2 PRIOR ART
FIG. 2 is a schematically depicted prior art foam dispenser.
Figure 5:
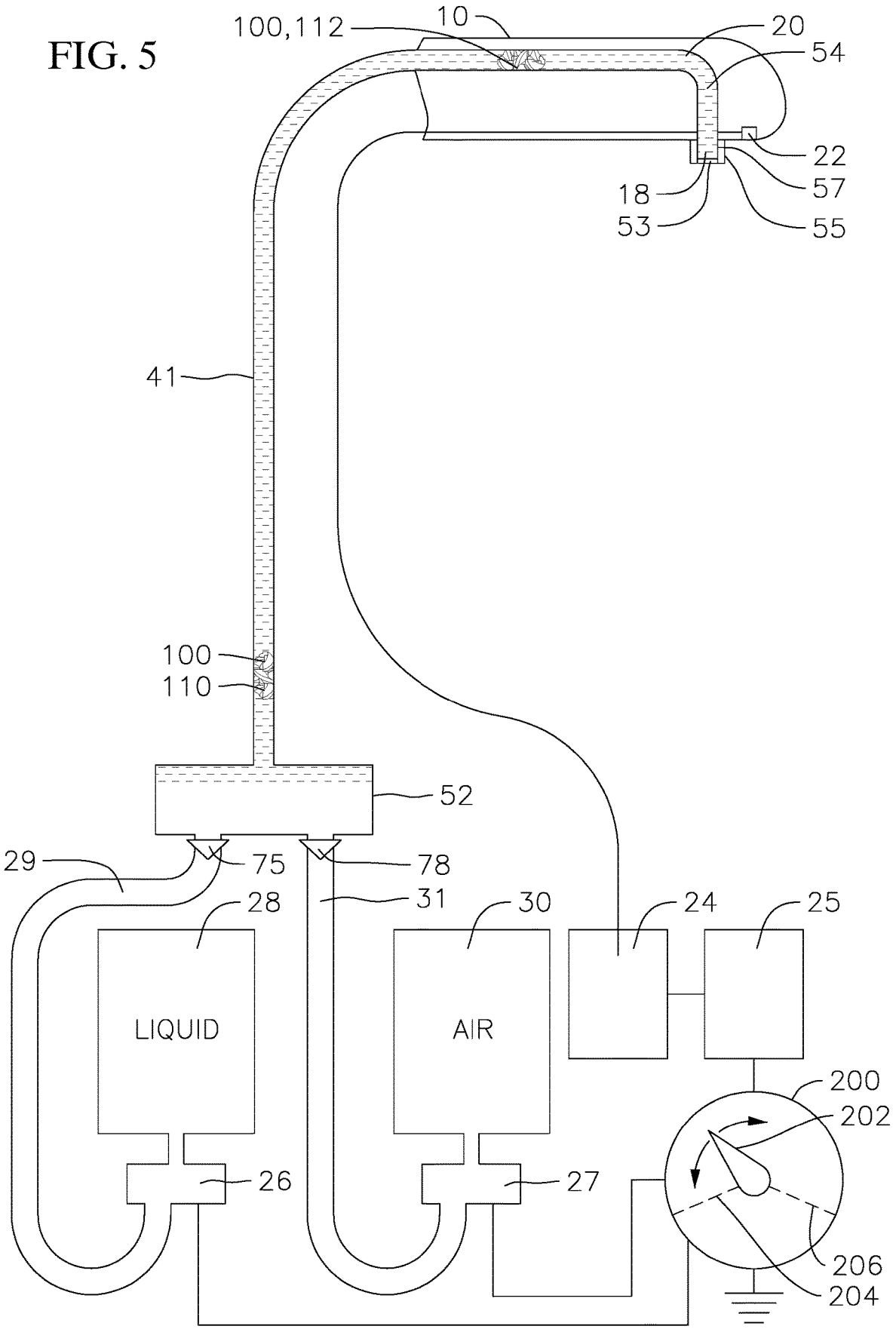
FIG. 5 is a schematically depicted exemplary embodiment foam dispenser.
Figure 6:
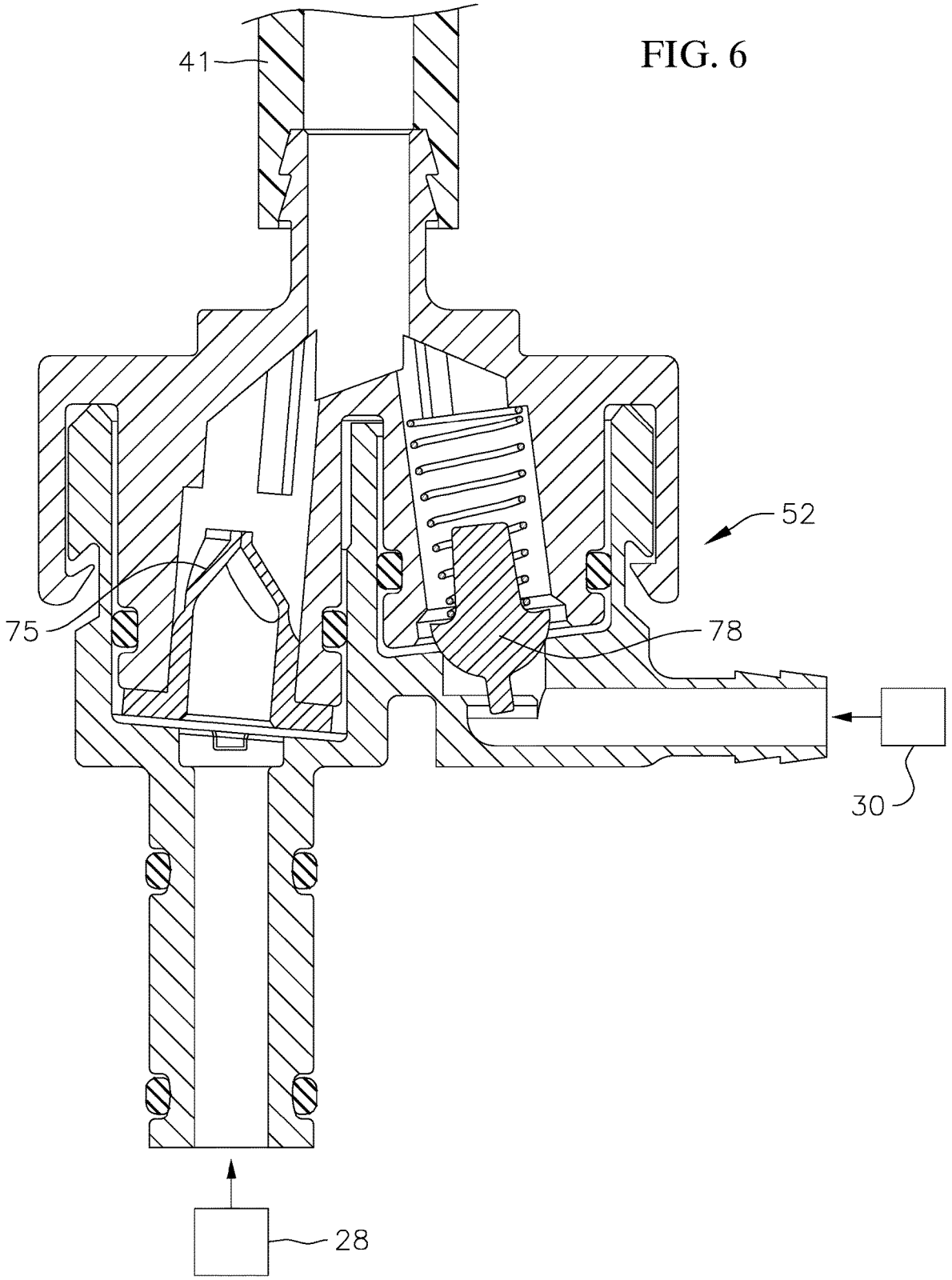
FIG. 6 is a cross-sectional view of an example embodiment mixing chamber incorporated in an example embodiment foam dispenser.

FIG. 5 discloses an exemplary embodiment foam dispenser. For convenience, the same reference numerals are used to denote the same components in the foam dispenser shown in FIG. 5, as the foam dispenser of the prior art disclosed in FIG. 2. With the exemplary embodiment, a mixing chamber 52, shown is cross-sectional view in FIG. 6, is provided to receive the liquid soap from the liquid soap reservoir or liquid source 28 and air from the air source 30. This mixing chamber in the shown example embodiment does not include a screen. The air source may be ambient air. The liquid soap and air are mixed in the mixing chamber and received in a conduit 41 for delivery to the dispensing opening or outlet 18. In the shown example embodiment, the conduit is tubing. The mixing chamber 52 includes a first one-way valve 75 in line with the liquid source and a second one-way valve 78 in line with the air source. The first one-way valve prevents prime loss by preventing back flow. The second one-way valve prevents liquid flow back flowing and clogging the air feed.

A first agitator 100, 110 is fitted in the tubing adjacent or proximate to the mixing chamber. In another example embodiment the first agitator is fitted in the tubing 41 at any location downstream of the mixing chamber 52 and upstream of the dispensing opening 18. In an example embodiment, the agitator has a length of ⅝ inch and a diameter of ¼ inch. In this example embodiment, the agitator includes three elements 102. The diameter of the agitator is chosen in an example embodiment such that it creates an interference fit with the inner surface of the tubing. In this regard, the agitator will stay in place within the tubing. In the example embodiment, the agitator has a ¼ inch outer diameter and the tubing has ¼ inch inner surface diameter.

In an example embodiment dispenser, a mesh 53 is mounted on the spout tip through which is defined the dispensing opening or outlet 18. In an example embodiment, the mesh is mounted externally of the spout tip so that it is easy accessible. In an example embodiment, the mesh is mounted on a ring 55 that connects, as for example by threading, to an external surface 57 of the spout. In this regard, the mesh can be easily connected to and disconnected from the dispensing outlet 18. An example embodiment mesh uses is a 200 mesh, which is a screen that has 200 openings per square inch. In another example embodiment, the mesh is a 300 mesh. In other example embodiment, instead of a single mesh, multiple spaced apart meshes are used. For example two 200 meshes spaces apart for a ¼ inch mounted on the ring 55 are used.

The liquid soap and air enter the mixing chamber and are mixed to form a liquid/air mixture. The liquid/air mixture then goes through the agitator 110 which creates a foamy mixture having bubbles and then it is dispensed by passing through the spout tip mesh 53.

In another example embodiment, a second agitator 100, 112 is incorporated into the tubing proximate the spout tip but before the spout tip mesh. In one example embodiment, the second agitator is placed at a location proximate the dispensing outlet such that the foam produced by the second agitator will have to travel two inches or less from the agitator to the dispensing outlet. In an example embodiment, the second agitator has a length of ⅝ inch and an outer diameter of ¼ inch. In an example embodiment, the second agitator is incorporated in the tubing in a location within the dispensing spout. As the foamy mixture created by the first agitator moves past the second agitator, the bubbles are further broken and/or reduced in size to create a more dense foam mixture. As this mixture contacts the mesh, the bubbles are further broken down create a better quality, i.e., a denser, foam mixture. The second agitator can have the same or a different number of elements than the first agitator.

In an example embodiment, by being mounted externally on the tip, as for example shown in FIG. 5, the mesh it may be easily removed from cleaning without having to take the dispenser apart. By using a mesh at the spout tip or proximate the spout tip (at a location easily accessible and above the counter to which the dispenser is mounted) the mesh can easily be removed and cleaned. With the example embodiment dispenser, there are fewer meshes to get clogged and that are difficult to access for the purpose of cleaning.

The length of each agitator may vary. In example embodiment, the length of each agitator may be longer than ⅝ inch. Testing conducted by applicant has shown that the foam quality does not vary much with an increased length. In other example embodiments, more than two agitators may be used inside the tubing. Use of more agitators may increase the quality/density of the foam produced. In an example embodiment, a mesh is not used at the spout tip.

In an example embodiment, a single agitator is used. Such agitator may occupy a majority of the length of the tubing 41.

In an example embodiment, the liquid pump 28 is used to pump the liquid soap to the mixing chamber. In an example embodiment the liquid pump 28 is a gear pump that is submerged in the liquid soap in the reservoir 14. In other embodiments, the pump may be a piston pump, a peristaltic pump or any other type of pump.

Figure 7:
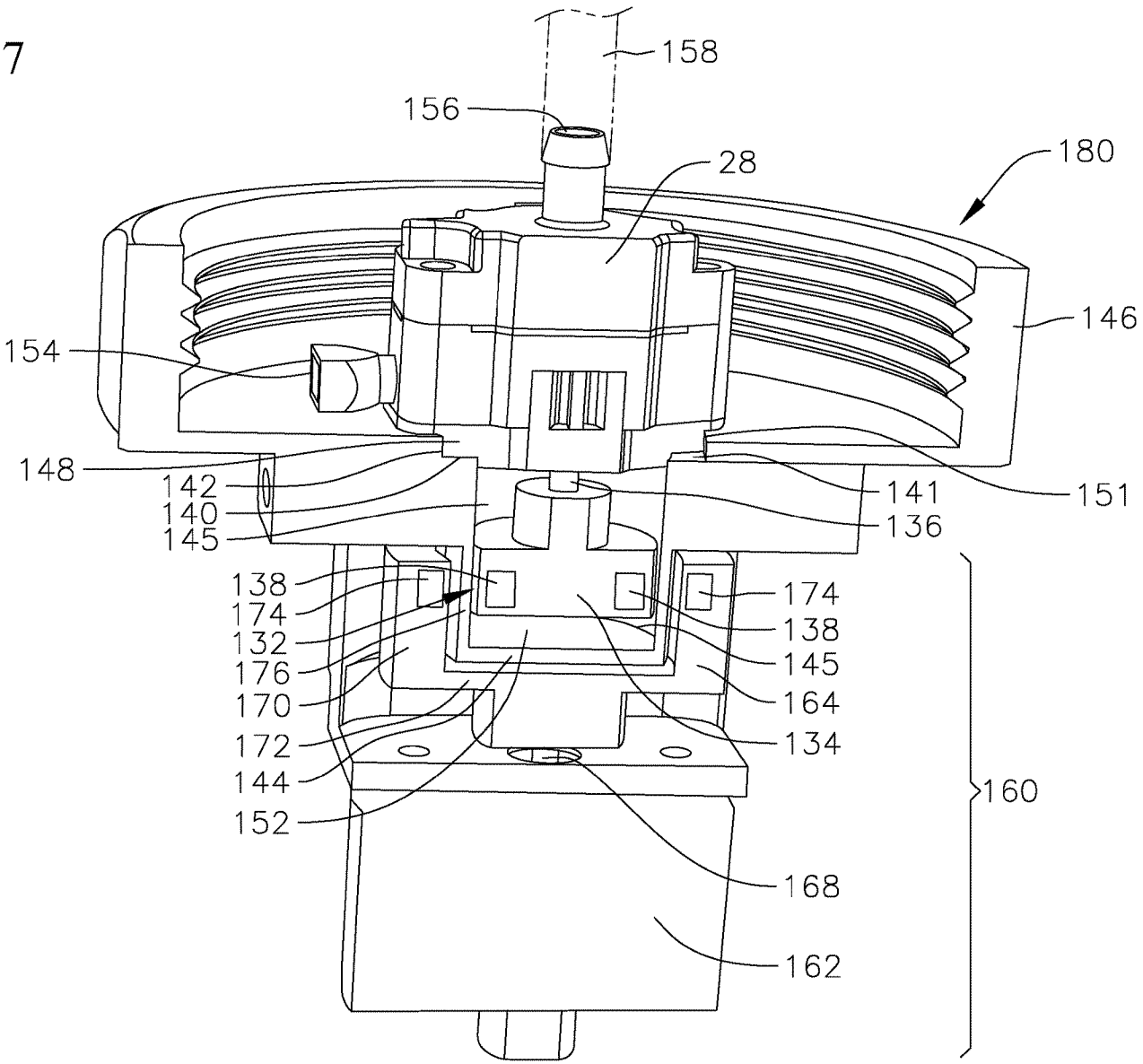
FIG. 7 is a partial cross-sectional view of a base portion of an example embodiment foam dispenser including a pump assembly.
Figure 8:
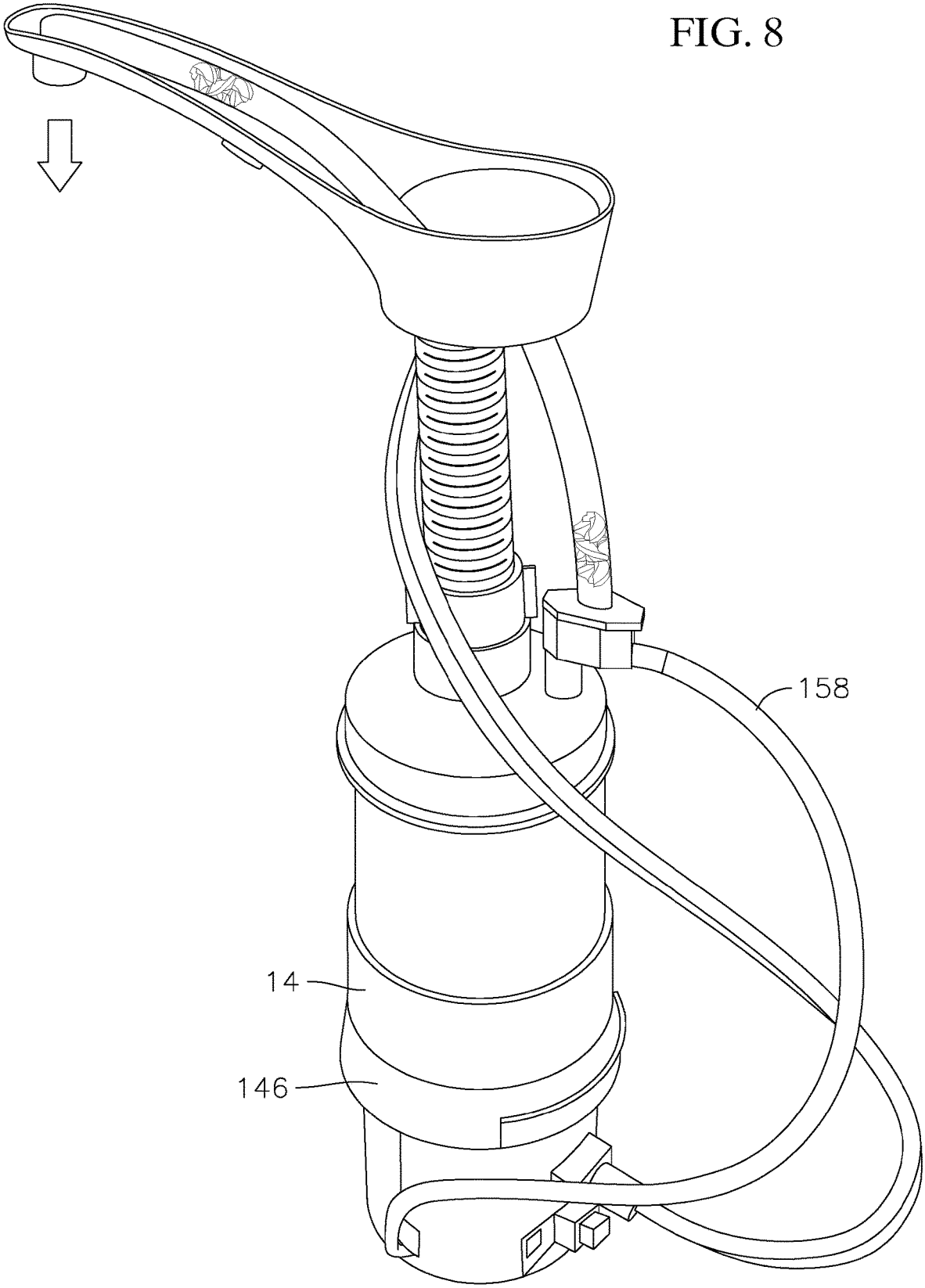
FIG. 8 is a perspective view of an example embodiment foam dispenser.

In the shown example embodiment, the liquid pump 28 is part of a pump assembly 132. The pump assembly 132 includes the pump 28, and a pump coupler or coupler cup 134 that is connected to the pump 28 by a pump shaft 136, as shown in FIG. 7. Rotation of the pump coupler rotates the pump shaft 136 which in turns rotates the pump and causes the pump to pump. In an exemplary embodiment, the coupler is a disc shaped member. Magnets 138 are incorporated in the coupler 136 at circumferentially spaced apart locations around the circumference of the pump coupler. In another exemplary embodiment, the coupler itself or any portion thereof may be made from a magnetic material. The pump 28 is seated on shoulder 140 within a depression 142 formed on a bottom wall 144 of a base portion 146 of the reservoir 14 (FIGS. 7 and 8). In an exemplary embodiment, the depression 142 has a shape complementary to an outer shape of a pump portion 148 that is received within the depression. Such pump portion may merely be a section extending from the pump. A wall 151 defining the depression 142 serves to restrain the pump from rotating when the pump shaft 136 is rotated. When the pump is seated on the shoulder 140, the coupler 136 is suspended in a further depression 145 extending from the depression 142. In another exemplary embodiment, the coupler may be seated on a base wall 152 of the depression 145.

In another exemplary embodiment, the pump 28 may be fastened to the base portion 146 with the pump coupler extending into the depression 145. In the exemplary embodiment, the pump is accommodated in the reservoir and is submerged in the liquid soap which it will pump. In the shown exemplary embodiment, the pump includes an inlet 154 and an outlet 156. Tubing 158 is provided extending from the pump outlet to the mixing chamber 52 for delivering the pumped liquid soap from the pump to the mixing chamber.

The pump assembly also includes a motor subassembly 160 which includes a motor 162 and a motor coupler 164 coupled to the motor via a motor shaft 168. The motor drives the motor coupler 164 via the motor shaft 168. In the shown exemplary embodiment, the motor coupler includes a tubular portion 170 extending from a base portion 172. Magnets 174 are mounted at locations circumferentially around the tubular portion. In another exemplary embodiment, the motor coupler, or any portion thereof, may be formed from a magnetic material. The magnets 174 or magnetic material are chosen such that they attract the magnets 138 or magnetic material on the pump coupler 134. The motor coupler tubular portion has an inner surface diameter that is slightly larger than an outer surface diameter of a wall 176 of the base portion 146 defining the depression 145. The motor shaft 168 is coupled to the base portion 172 of the motor coupler 164 and rotates the motor coupler about a central longitudinal axis of the tubular portion 170.

The motor subassembly 160 is coupled to the reservoir 14 such that the tubular portion 170 of the motor coupler surrounds the circumferential wall 176 of the depression 142. The motor subassembly may be connected to the reservoir by any method. For example, the motor may be fastened to a lower housing 180 which defines the base portion 146 of the reservoir 14, as shown in FIGS. 7 and 8. The lower housing 180 may be threaded, fastened or otherwise attached to the reservoir 140 body. In the shown exemplary embodiment, the connection between the lower housing 180 and the reservoir allows for the easy removal of the motor or motor subassembly from the remainder of the reservoir by unthreading of the lower housing and thus, allowing for easy replacement or servicing.

When properly mounted to the reservoir, the magnets 174 on the motor coupler magnetically attract the magnets 138 on the pump coupler, which pump coupler is separated from the motor coupler by the walls 176 defining depression 145, such that rotation of the motor coupler causes rotation of the pump coupler. As a result, as the motor rotates the motor coupler, the motor coupler causes the pump coupler to rotate which in turn causes the pump to pump out the liquid within the reservoir through the pump outlet 156. The rotational energy of the motor is transferred magnetically through the reservoir without requiring any openings through the reservoir, and thus, avoiding potential leak forming sites through the reservoir base.

In an exemplary embodiment, at least one magnet is incorporated into one of the pumps and motor couplers while at least a metal piece is incorporated in the other of the pumps and motor couplers which is attracted by the magnet. The magnet and metal piece may be arranged circumferentially around their respective coupler. When multiple magnets and metal pieces are used, the magnets and metal pieces are arranged around their respective coupler such that each magnet is radially alignable with a corresponding metal piece. In yet another exemplary embodiment, each coupler may include magnets and metal pieces such that a magnet of the pump coupler is radially alignable with a metal piece of the motor coupler and a magnet of the motor coupler is radially alignable with a metal piece incorporated on the pump coupler. In other exemplary embodiment, each coupler may include a single magnet and/or metal piece. In an exemplary embodiment, a single magnet which is ring-shaped may be used as part of either the pump coupler and/or the motor coupler.

Pumps such as gear pumps 28 used to pump liquid soap to be transformed to foam have an output that varies and often is not consistent from pump to pump or between identical pumps. In addition, the use of coupler cups (i.e., pump coupler) 134 in a pump assembly adds to the variance in output. For example, typical pumps are required to have an output between 375 ml/min to 405 ml/min. Use of a coupler cup can result in the fluctuation of the output between 30 ml/min to 50 ml/min.

To deal with the fluctuation in the liquid pump output, in an example embodiment, a potentiometer 200 is provided that controls the liquid pump 26 and air pump 27 (FIG. 5). The potentiometer controls the power (i.e., voltage) delivered from the power source 25 to drive the liquid pump 28 as well as the power delivered to drive the air pump 30. As the power (i.e., voltage) supplied across each of the liquid pump and air pump is increased, so does the RPM of each of such pump and its corresponding output. If the voltage across each of such pumps is decreased so does the pump RPM and corresponding output The potentiometer has a control 202 that can be rotated or otherwise moved between a first position 204 and a second position 206 (FIG. 5). The control between the two pumps is inverse such that when the potentiometer control is rotated or moved to the first position 204, the powers provided will be such that the liquid pump is operated at a predefined maximum speed while the air pump is operated at a predefined minimum speed, and when the potentiometer control is rotated or moved to the second position 206, the liquid pump is operated at a predefined minimum speed while the air pump is operated at a predefined maximum speed. In an example embodiment, when the control is rotated or moved to the second position, the liquid pump is operating at its predefined minimum speed while the air pump is operating at the 70% of its true maximum speed. Thus, moving the potentiometer control 202 from the first position to the second position decreases the power supplied to the motor of the liquid pump and increases the power supplied to the motor of the air pump and moving the control from the second position toward the first position, increases the power supplied to the liquid pump and decreases the power supplied to the motor of the air pump.

In an example embodiment, when the potentiometer control is in the middle setting between the first position and the second position, 4.7 V is applied to a gear liquid pump motor while 3.3 V is applied to the air pump motor. At the first position (or a maximum setting) 6 V is applied to a gear liquid pump motor while 1.92 V is applied to the air pump motor. When in the second position (or a minimum setting) 3.3 V is applied to the gear liquid pump motor while 4.2 V is applied to the air pump motor. In an example embodiment, with any of the aforementioned embodiment, at no point will one of the two pumps be on while the other one is off. With this example embodiment, the potentiometer can be set to account for the variance of the coupler cup or pump used so that the quality of the foam produced is maintained.

In other example embodiments, any device may be used that can control the power supplied to the liquid and air pumps by simultaneously increasing the power delivered to one pump while decreasing the power delivered to the other pump. For example a controller may be used to that can control the voltage supplied to the liquid pump and the air pump such that as the voltage supplied to the liquid pump is increased, the voltage supplied to the air pump is decreased, and such that as the voltage supplied to the liquid pump is decreased, the voltage supplied to the air pump is increased. The controller may be a processor that allows for such control and variance of the voltages supplied to each of the pumps. In an example embodiment, the controller mimics the function of a potentiometer. In an example embodiment, the variance in the voltage supplied to the liquid pump is simultaneous with the variance in the voltage supplied to the air pump. In other words, the controller allows for the desired rate of increase and simultaneous decrease of power delivered to each pump, respectively. In an example embodiment, the variance of the voltage supplied to each of the liquid pump and the air pump as the selector is moved between the first and the second positions is linear. In another example embodiment, the variance of the voltage supplied to each of the liquid pump and the air pump as the selector is moved between the first and the second positions may be linear or non-linear or may be linear for one of the two pumps and non-linear for the other of the two pumps. In another example embodiment, the variance of the output of each of the liquid pump and air pump as the selector is moved between the first and the second positions is linear. In another example embodiment, the variance of the output of each of the liquid pump and the air pump as the selector is moved between the first and the second positions may be linear or non-linear or may be linear for one of the two pumps and non-linear for the other of the two pumps. In an example embodiment, the device or controller may be programmable to allow for selecting the desired power and/or variance of power supplied to each of the pumps. In other words, the controller allows for the adjustment of the output of both pumps with a single selector.

With the example embodiment dispensers, once a liquid soap is selected, an operator will move the selector of the controller (e.g., a potentiometer) so as to inversely simultaneously vary the outputs of the liquid soap pump and the air pump so as to produce better or desired quality foam. In an example embodiment, the dispenser may come with suggested or pre-selected settings of where the selector must be set to for producing the desired foam for various types of liquid soaps.

This invention has been described for illustration purposes for use with a hands-free dispenser which uses a sensor to sense a target, such as a person's hands, such as an infrared sensor. In another exemplary embodiment, the dispenser may be electro-mechanical, as for example the user presses the dispenser spout 10 or a switch which in turn sends an electrical signal to the pumps to operate the pumps for pumping the liquid soap and the air. In other example embodiments, the controller and/or potentiometer as described herein may be used with any type of foam dispenser where liquid soap and air is supplied to form the foam whether or not the dispenser uses agitators or screens of other devices to form the foam.

Although the present invention has been described and illustrated in respect to exemplary embodiments, it is to be understood that it is not to be so limited, since changes and modifications may be made therein which are within the full intended scope of this application.

What is claimed is:

1. A foam dispenser comprising:

an air pump for pumping and outputting air;

a liquid pump for pumping and outputting liquid;

a mixing chamber for receiving the liquid output by the liquid pump and the air output by the air pump; and a controller for inversely controlling the liquid output of the liquid pump and the air output of the air pump, wherein each pump is powered by a voltage source and wherein the controller controls the amount of voltage supplied to each pump, wherein the controller comprises a selector that is moveable from a first position to a second position, wherein the amount of voltage supplied to the liquid pump is at a predefined maximum at the first position and at a predefined minimum at the second position, and wherein the amount of voltage supplied to the air pump is at a predefined minimum at the first position and at a predefined maximum at the second position.

2. The dispenser as recited in claim 1 wherein the controller allows for increasing the output of one of said liquid and air pumps while simultaneous decreasing the output of the other of the liquid and air pumps.

3. The dispenser as recited in claim 1, wherein the controller is a potentiometer.

4. The dispenser as recited in claim 1, the predefined maximum voltage for the liquid pump is 6 volts and the predefined maximum voltage for the air pump is 4.2 volts.

5. The dispenser as recited in claim 4, wherein the predefined minimum voltage for the liquid pump is 3.3 volts and the predefined minimum voltage for the air pump is 1.92 volts.

6. The dispenser as recited in claim 1, wherein the predefined maximum voltage for the liquid pump is 6 volts and the predefined minimum voltage for the air pump is 1.92 volts.

7. The dispenser as recited in claim 1, wherein the predefined minimum voltage for the liquid pump is 3.3 volts and the predefined maximum voltage for the air pump is 4.2 volts.

8. The dispenser as recited in claim 1, wherein the predefined maximum voltage for the liquid pump is greater than the predefined maximum voltage for the air pump.

9. The dispenser as recited in claim 1, wherein the predefined minimum voltage for the liquid pump is greater than the predefined minimum voltage for the air pump.

10. The dispenser as recited in claim 1, wherein the predefined minimum voltage for the liquid pump is less than the predetermined maximum voltage for the air pump.

11. The dispenser as recited in claim 1, wherein at the second position, the air pump is operating at 70% of its maximum speed.

12. The dispenser as recited in claim 1, wherein as the controller selector is moved from the first position to the second position, the voltage supplied to the liquid pump is gradually decreased from its predefined maximum to its predefined minimum and the voltage supplied to the air pump is gradually increased from its predefined minimum to its predefined maximum, and as the controller selector is moved from the second position to the first position, the voltage supplied to the liquid pump is gradually increased from its predefined minimum to its predefined maximum and the voltage supplied to the air pump is decreased from its predefined maximum to its predefined minimum.

13. The dispenser as recited in claim 12, wherein the variance in voltage supplied to the liquid pump as the selector is moved from the first position to the second position is linear and the variance in the voltage supplied to the air pump is linear.

14. The dispenser as recited in claim 1, wherein the controller is a potentiometer.

15. A foam dispenser comprising:

an air pump for pumping and outputting air;

a liquid pump for pumping and outputting liquid;

a mixing chamber for receiving the liquid output by the liquid pump and the air output by the air pump; and a potentiometer having a selector for simultaneously and inversely controlling the liquid output of the liquid pump and the air output of the air pump by moving said selector.

16. The dispenser as recited in claim 15, wherein the potentiometer inversely and linearly varies the outputs of the liquid pump and air pump.

17. The dispenser as recited in claim 15, wherein the potentiometer inversely and non-linearly varies the outputs of the liquid pump and air pump.

18. The dispenser as recited in claim 15, wherein the potentiometer varies the output of one of the liquid pump and air pump linearly and the other of the liquid pump and air pump non-linearly.

19. The dispenser as recited in claim 15, wherein as the potentiometer selector is moved from a first position to a second position, a voltage supplied to the liquid pump is gradually decreased from a predefined liquid pump maximum voltage to a predefined liquid pump minimum voltage and a voltage supplied to the air pump is gradually increased from a predefined air pump minimum voltage to a predefined air pump maximum voltage, and as the potentiometer selector is moved from the second position to the first position, the voltage supplied to the liquid pump is gradually increased from the predefined liquid pump minimum voltage to the predefined liquid pump maximum voltage and the voltage supplied to the air pump is decreased from the predefined air pump maximum voltage to the predefined air pump minimum voltage.

20. The dispenser as recited in claim 19, wherein the predefined liquid pump maximum voltage is greater than the predefined air pump maximum voltage.

21. The dispenser as recited in claim 19, wherein the predefined liquid pump minimum voltage is greater than the predefined air pump minimum voltage.

* * * * *